US006881153B2

(12) United States Patent
Andrews

(10) Patent No.: US 6,881,153 B2
(45) Date of Patent: Apr. 19, 2005

(54) BILLIARD, SNOOKER AND POOL CUE SHAFT

(75) Inventor: John W. Andrews, Red Deer (CA)

(73) Assignee: John Andrews, Red Deer (CA)

( * ) Notice: Subject to any disclaimer, the term of this patent is extended or adjusted under 35 U.S.C. 154(b) by 0 days.

(21) Appl. No.: 09/864,197

(22) Filed: May 25, 2001

(65) Prior Publication Data

US 2001/0046903 A1 Nov. 29, 2001

(30) Foreign Application Priority Data

May 25, 2000 (CA) ..... 2309622

(51) Int. Cl.[7] ..... A63D 15/08
(52) U.S. Cl. ..... 473/47
(58) Field of Search ..... 473/44–49

(56) References Cited

U.S. PATENT DOCUMENTS 818,597 A * 4/1906 Wilson ..... 473/49
829,749 A * 8/1906 Adorjan ..... 473/47
835,489 A * 11/1906 Adorjan ..... 473/47
1,252,632 A * 1/1918 Voje ..... 473/44
1,560,456 A * 11/1925 Wolpert ..... 473/44
1,705,353 A * 3/1929 Barrett ..... 473/47

FOREIGN PATENT DOCUMENTS

| | | |
|---|---|---|
| CA | 233389 | 8/1923 |
| CA | 726578 | 1/1966 |
| CA | 738297 | 7/1966 |
| CA | 773959 | 12/1967 |
| CA | 2126836 | 12/1995 |

* cited by examiner

*Primary Examiner*—Mark S. Graham
(74) *Attorney, Agent, or Firm*—L. Anne Kinsman; Borden Ladner; Gervais LLP

(57) ABSTRACT

The present invention relates to a tip section for a cue stick for use in billiards, snooker and pool. The tip section may be connected to either a butt section of a two piece cue, or to the shortened shaft end of an existing cue stick butt section. The tip section is composed of a hollow tube into which stiffening members and weights may be introduced to alter the weight, balance, flex and kick of the tip section. The tip section can be retrofitted to an existing butt section, used to repair a cue stick with a damaged tip segment, or be part of a new cue.

10 Claims, 4 Drawing Sheets

BILLIARD, SNOOKER AND POOL CUE SHAFT

TECHNICAL FIELD OF THE INVENTION

The present invention relates to design and construction of cue sticks for billiard, pool, snooker and the like.

BACKGROUND ART

The art of cue sticks and shaft extensions for cue sticks consists of cue stick shafts manufactured from solid wood and graphite. These cue stick shafts and extension shafts typically provide strong frictional resistance to the player when in use and require the player to use hand powder, talcum powder, or some other external substance to reduce this friction between bridging fingers and shaft. The finishing of the wood and graphite cue stick shafts traditionally requires an extra coating step in manufacture, and is susceptible to wear, which degrades both functionality and appearance. The long-term wear and functional capabilities of graphite shafts are not known, and the use of carbon-fiber and graphite materials is expensive, while the materials are themselves fragile in some circumstances. Wooden cue stick shafts are susceptible to flaws inherent in the wood stock used, and to warping, twisting and deformation due to the nature of the materials used, which is detrimental to their usability to the player.

Previously, there have been inventions involving hollow-bodied cues, for instance Canadian Patent No. 233,389 teaches a hollow-bodied cue butt section with a removable tip section. The tip section is designed to be removed and may be placed into the hollow cue butt section for storage and transport. Canadian Patent No. 738,297 teaches a hollow-bodied cue stick wherein several segments could collapse longitudinally, telescoping within themselves, for ease of transport and storage. One draw back of this design is that a stick equal in length to the cue stick is required to be inserted within the cue stick to straighten the cue stick and to prevent the cue stick from collapsing during operation.

Canadian Patent No. 726,578 to Adler teaches a method of constructing a hollow tube for use as a billiard cue or fishing rod using fiber and resin to form a hard hollow outer layer. Stiffener rods and spring weights are then inserted into the hollow tube to alter the weight and balance of the cue, and to provide the desired flex and kick. Once the manufactured cue stick has the desired characteristics, it is filled with liquid foam, which hardens to form a one-piece balanced fiberglass cue. Additional features of the Adler invention included novel ferrules, joints, attachments of butt-bumpers and tips, and non-slip coatings. The Adler patent is limited to the construction of cue sticks and fishing rods from foam-filled, weighted and balanced, resin-impregnated glass fiber cloth, and necessary changes to fittings and fixtures. Additionally, Adler discloses a cue that may only be weighted and balanced during initial construction. Once manufactured, the cue sticks cannot be customized "in the field" at the retailer or after sale to an end-user or altered to suit an end-user's requirements or desired characteristics. Adler also does not address issues of cue shaft repair, and the materials disclosed are susceptible to damage, cracking, chipping, and wear, as well as requiring significantly different and more numerous steps in their manufacture.

Other products provide a limited number of cue sticks with adjustable weight and balance after initial manufacture. Such cue sticks employed methods of attaching weighted washers or similar devices onto the exterior of the cue stick, such as onto the existing butt end cap, or center fastener ferrules or fittings in the case of two piece cue sticks. However, the cue stick's weight was otherwise predetermined by the materials and methods used in its initial construction. Similarly, the flex and kick characteristics of the cue sticks were determined by the materials and methods used in the cue sticks initial construction and finish.

Finally, an examination of the cues and parts and components available from major manufacturers such as Brunswick™, Champion™, Dufferin™, Heubler™, Monarch™, Macdermitt™, Harvard™, AMF™, Schmelke™, Wilson™, Spalding™, Excalibur™, Viper™, Winston™, Zodiac™ and others has disclosed a variety of cue sticks and cue stick-sections. However, the operational characteristics of such cue sticks are determined by the materials used in their construction, and do not allow post-manufacture customization by the user or by a customizer.

It is an object of the present invention to obviate or mitigate at least some of the above-presented disadvantages.

SUMMARY DESCRIPTION OF THE INVENTION

In accordance with one aspect of the present invention there is provided a tip section for customizing a cue stick. The tip section comprises a hollow tube having a first end and a second end, the tube having an exterior providing a substantially smooth surface, the tube having a wall capable of self-support. A first attachment site adjacent to the first end for connecting the tube to a cue tip, and a second attachment site adjacent to the second end for connecting the tube to a butt section.

In accordance with one aspect of the present invention there is provided a tip section for customizing a cue stick. The tip section comprises a hollow tube having a first end and a second end, the tube having an exterior providing a substantially smooth surface, the tube having a wall capable of self-support. A first attachment site adjacent to the first end for connecting the tube to a cue tip, and a second attachment site adjacent to the second end for connecting the tube to a butt section. The tube further comprises an augmenting element securable to an interior position within the hollow tube, the augmenting element being either a weight or a stiffening member. Placement of the augmenting element in the interior position within the hollow tube is determined by a locator. Placement of said augmenting element tailors an operational characteristic of the hollow tube.

In accordance with another aspect of the present invention there is provided a kit for customizing a tip section of a cue stick. The kit comprising a hollow tube having a first end and a second end, the tube having an exterior providing a substantially smooth surface, the tube having a wall capable of self-support. A first attachment site adjacent to the first end for connecting the tube to a cue tip, and a second attachment site adjacent to the second end for connecting the tube to a butt section. The kit can also include an augmenting element securable to an interior position within the hollow tube, the augmenting element being either a weight or a stiffening member. Placement of the augmenting element in the interior position within the hollow tube is determined by a locator. Placement of said augmenting element tailors an operational characteristic of the hollow tube.

It is an object of the present invention to provide a means of imparting adjustable weight, balance, flex and kick operational characteristics of a tip section of a cue stick.

It is a further object of the present invention to provide a tip section for cue sticks which can be either manufactured as a part of a two piece cue stick, manufactured as a single-piece cue stick, or provided as a repair or replacement part for a cue stick.

It is a further object of the present invention to provide a substantially smooth surface to the exterior of a tip section of a cue stick for sliding engagement over a surface.

BRIEF DESCRIPTION OF THE DRAWINGS

These and other features of the preferred embodiments of the invention will become more apparent in the following detailed description in which reference is made to the appended drawings wherein.

DESCRIPTION OF PREFERRED EMBODIMENTS

Figure 1:
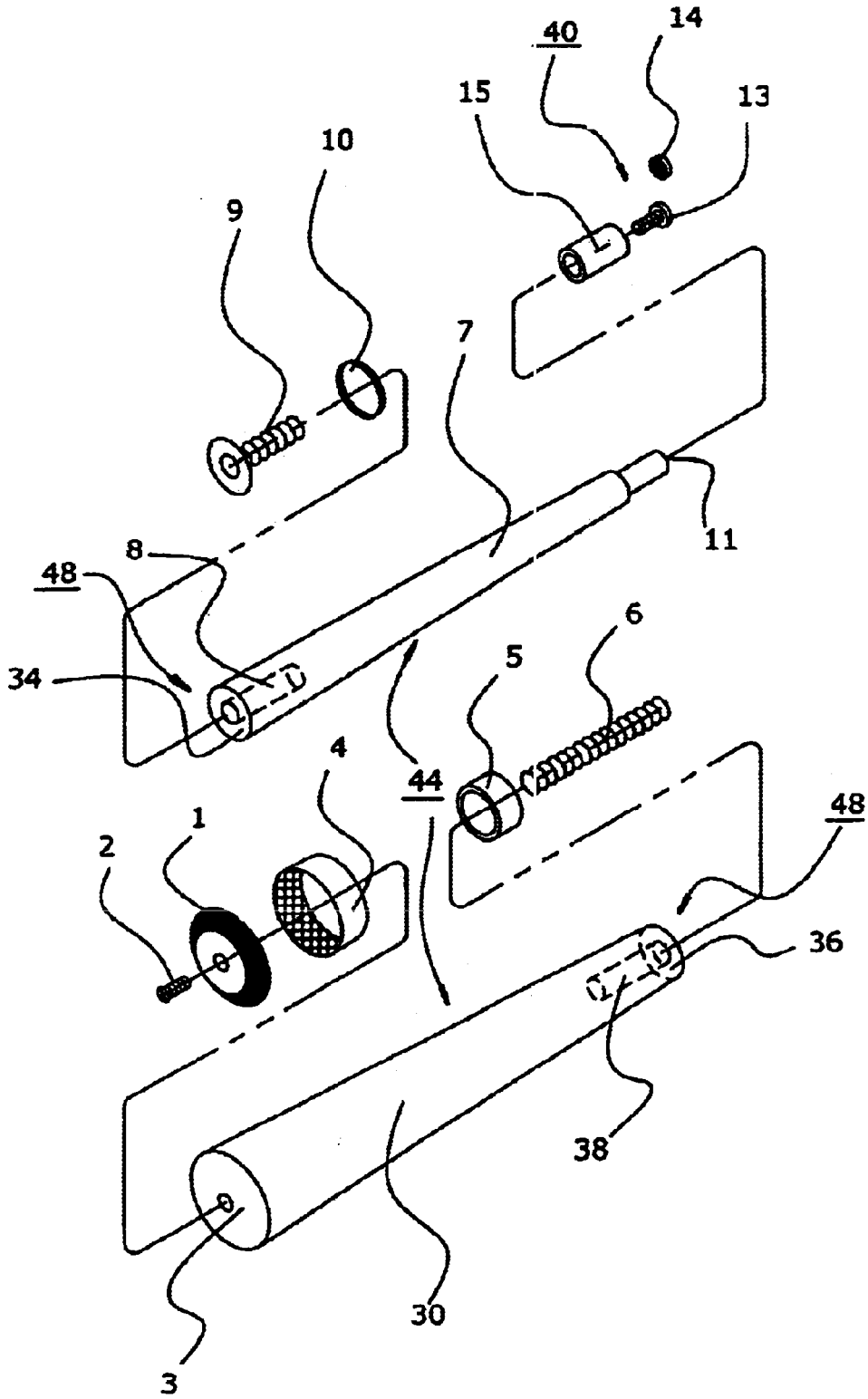
FIG. 1 Prior Art
FIG. 1 is an exploded view of a prior art example two-piece billiard cue stick.

The present invention relates to the production of customized cue sticks to meet the specific demands of clients. More specifically, the present invention relates to the forward section or tip section of a cue stick in which certain operational characteristics relating to weight, balance, kick and flex may be altered. In a preferred embodiment, the tip section is a hollow, tapered tube, though non-tapered tubes may also be used in the construction of the tip section. Augmenting elements such as weights and stiffening members may be inserted into the interior of the tip section by the user or customizer after manufacture of the tip section to tailor certain operational characteristics of the tip section, and hence the cue stick.

A series of descriptive terms is used to describe certain operational characteristics of cue sticks. To facilitate the understanding of the preferred embodiments of the present invention described below, the following terminology will be used.

Weight—a term used to describe the overall weight of a cue stick.

Balance—a term used to describe the location of the center of gravity of a cue stick along its length, or the weight distribution of a cue stick along its length.

Flex—the amount of longitudinal rigidity of a cue stick's structure. A rigid cue stick is said to have little flex.

Kick—a term used by pool players to describe the tactile feedback during and after striking a ball with the cue stick. Advanced players typically seek very straight, low-flex, rigid cue sticks with more kick.

Several elements of the present invention that are common to conventional cue stick construction and assembly. These elements will be described with reference to FIG. 1, which describes a two piece cue stick 44 known in the prior art. Cue sticks 44 are generally tapered cylinders having a wide end or butt end 3, and a narrow end 11. The cue stick 44 may be divided along its length into two sections: the tip section 7 extending from generally the middle 48 of the cue stick towards the narrow end 11, and the butt section 30 extending from generally the middle 48 of the cue stick 44 towards the butt end 3.

The butt end 3 of a cue stick 44 may be terminated by a butt bumper 1, typically of rubber and typically attached with a screw 2 to the butt end 3, and a trim ring 4 which may be placed between the butt bumper 1 and the butt end 3. The narrow end 11 of the cue stick 44 is terminated with a cue tip 40. At play, the cue tip 40 comes in direct contact with a ball to be struck. The narrow end 11 of the tip section 7 has tip attachment point 35 for a cue tip 40. A cue tip 40 is typically composed of a leather tip 14 with threaded brass body 13. Other configurations of cue tips 40 are known in the art and may be used in the present invention. In one embodiment, the tip attachment point 35 is provided by the insertion of a threaded nut 15 into the narrow end 11 of the tip section 7. The threaded nut 15 is preferably rounded, such that the outer part of the threaded nut 15 resembles a slightly tapered cylinder. The threaded nut 15 is fixed in position by a variety of methods known in the art such as friction, an adhesive, a set-screw, welding, and the like. In a preferred embodiment, the threaded nut 15 is affixed in the narrow end 11 of the tip section 7 by use of suitable epoxy-type adhesive. The threaded brass body 13 of the cue tip 40 is then secured to the threaded nut 15.

At approximately the middle of the cue stick's length is provided a releasable joint 48. Various examples are known for connecting the butt section 30 to the tip section 7 of two-piece and multi-piece cue sticks 44. In one example, a bore 38 is drilled into the narrow end 36 of the butt section 30 along the centerline. A bore 8 is also drilled into the wide end 34 of the tip section 7 along the centerline. A threaded nut 9 is affixed into the bore 8 of the tip section 7. The threaded nut 9 may be secured by use of an adhesive, or other methods known in the art. In an alternative embodiment, the bore 8 may be threaded. A screw member 6 is then secured into the bore 38 of the butt section 30. The screw member 6 being a size and thread such that it can be mated with the threaded nut 9 or threads in bore 8 of the tip section 7. Typically, a joint collar 5 and a trim ring 10 will be placed between the butt section 30 and tip section 7 at the releasable joint 48.

In an alternate embodiment, the joint 48 is a not a releasable joint, and the butt section 30 is permanently attached to the tip section 7 of the cue stick. Many examples are known to permanently attach the tip section 7 to the butt section 30. In one embodiment, a bore 38 is drilled into the narrow end 36 of the butt section 30 along the centerline. A bore 8 is also drilled into the wide end 34 of the tip section 7 long the centerline. One end of a connector element 6 is inserted into the bore 38 of the butt section 30, and the other end of the connector element 6 is inserted into the bore 8 of the tip section 7. The connector element 6 is secured in place with the use of a suitable epoxy-type adhesive, or other methods known in the art.

When the two pieces of the cue stick 44 of FIG. 1 are connected together, the cue stick 44 is operated by moving the cue stick 44 substantially along its longitudinal axis. Preferably the tip section 7 is held or supported near the gaming table surface, with the cue tip 40 resting in close proximity to a ball to be struck, such as the cue ball in pool. The butt section 30 is gripped by the user's hand and is used to propel the cue stick 44 towards the ball to be struck.

Figure 2:
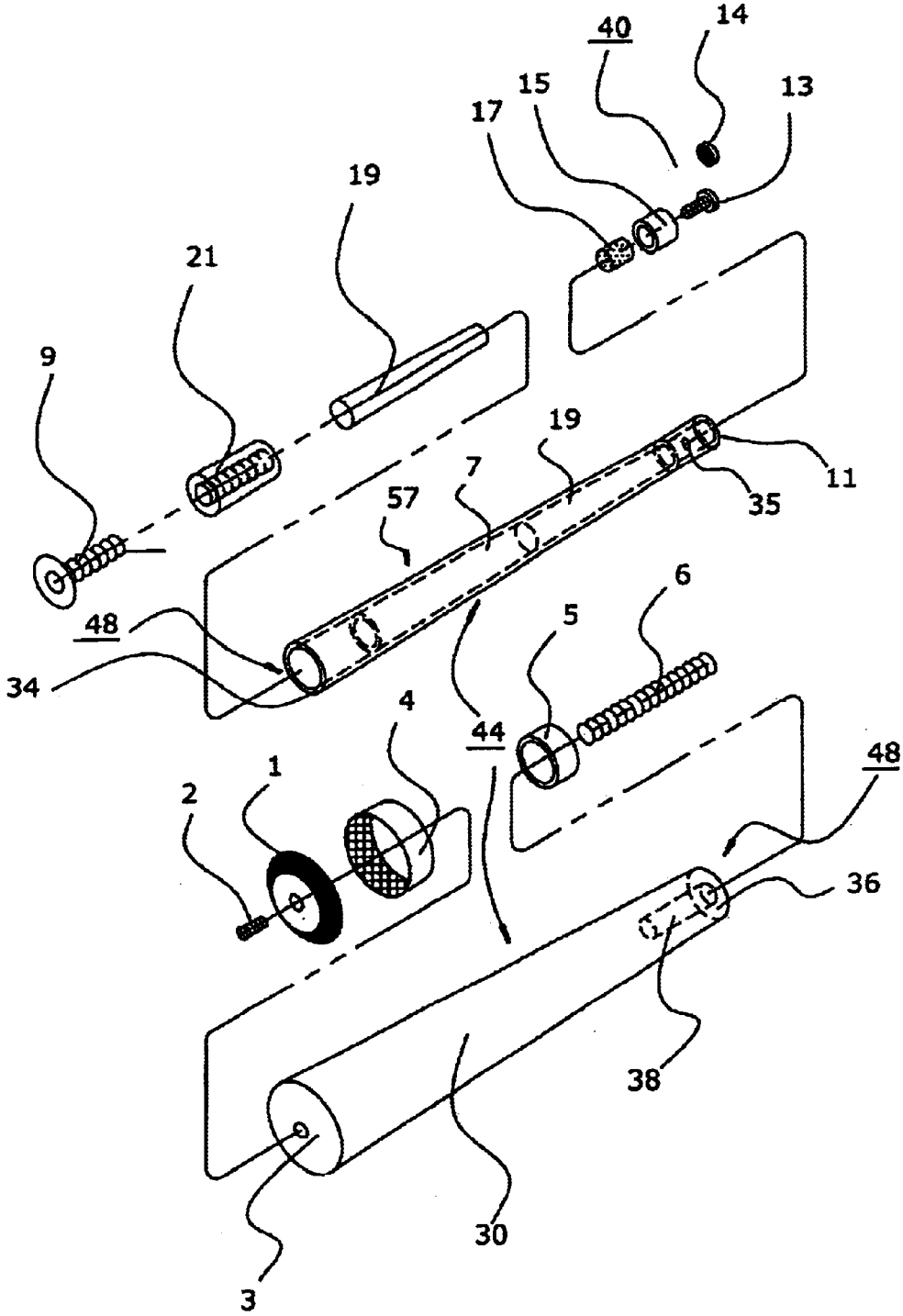
FIG. 2 is an exploded view of a two-piece cue stick.

With reference to FIG. 2, the tip section 7 of the present invention is preferentially a tapered tube 57 having a narrow end 11 and a wide end 34. The taper may be either gradual or in small incremental reductions in diameter. Non-tapered tubes 57 may also be used in the present invention, though non-tapered cue sticks 44 are not commonly used on the date of the present invention.

In a preferred embodiment, the tube 57 is composed of a material such as steel or metal selected for desired characteristics such as light-weight, strength, corrosion resistance, high tensile strength, low compressibility. Examples of such metals include light-weight steel, aluminum, steel, stainless steel, magnesium alloys, and the like. The tube 57 may also be produced from other materials such as carbon fiber, graphite, fiberglass, ceramic, plastic and the like. The interior of the tube 57 should provide a hollow space. The walls of the tube 57 should be capable of self-support such that the tube 57 is sufficiently rigid and strong to strike a ball along the tube's 57 longitudinal axis. The material used to construct the tube 57 may itself be self-supporting, or the tube 57 may be capable of being self-supporting following the introduction of elements into the interior of the tube 57 which increase the rigidity of the tube 57. The tube 57 may be constructed of a material such that the weight of the tube 57 may be approximately equal to the weight of an equal length of tip section 7 from a wooden cue stick 44. In a preferred embodiment, the weight of the tube 57 is less than the weight of an equal length of a tip section 7 from a wooden cue stick 44.

The cue stick 44 of the present invention may be used for a variety of games such as pool, snooker, billiards, and the like. As will be obvious to those skilled in the art, such games may differ in the regulations governing the dimensions of cue sticks 44. Therefore, in producing a tip section 7 for billiards, a tapered tube 57 may be selected which has dimensions and taper that conforms to the professional standards of dimensions and taper for billiard cue sticks. The external diameter the wide end 34 of the taper tube 57 can be sufficient for the flush or substantially flush attachment to a butt section 30. The narrow end 11 of the taper tube 57 can have an external diameter sufficient for the flush or substantially flush attachment of a cue tip 40.

The tip section 7 of the cue stick 44 is supported near the ball to be struck by a bridge or in the player's bridge hand. During the act of striking the ball, the tip section 7 is slid across the bridge or hand. In one embodiment of the present invention, the tip section 7 has an outer surface material which offers low resistance when in sliding contact with the bridge or bridge hand. Hence, the tapered tube 57 used to construct the tip section 7 is preferably composed of material capable of accepting a durable polished finish or chrome-plating or other similar high-gloss, low-friction surface finish. Examples of such outer surface materials include, but are not limited to, chrome-plating, polished aluminum, titanium, and the like.

Figure 3A:
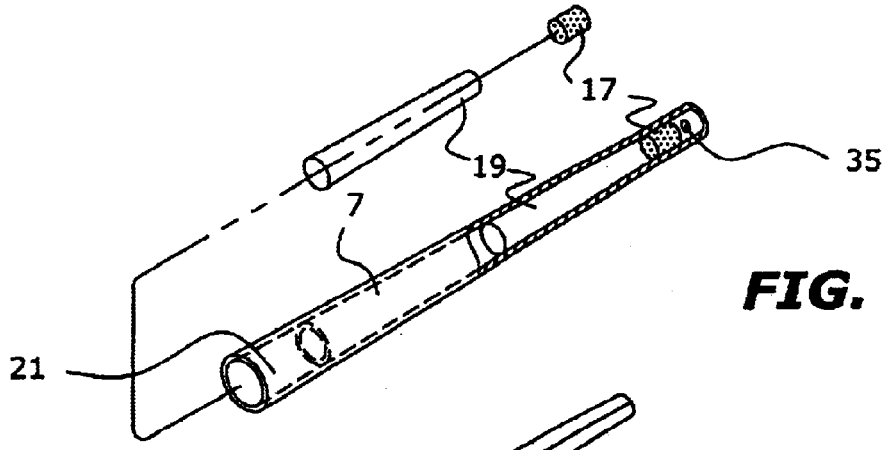
FIGS. 3A, B and C are alternate embodiments of the tip section of FIG. 2.
Figure 3B:
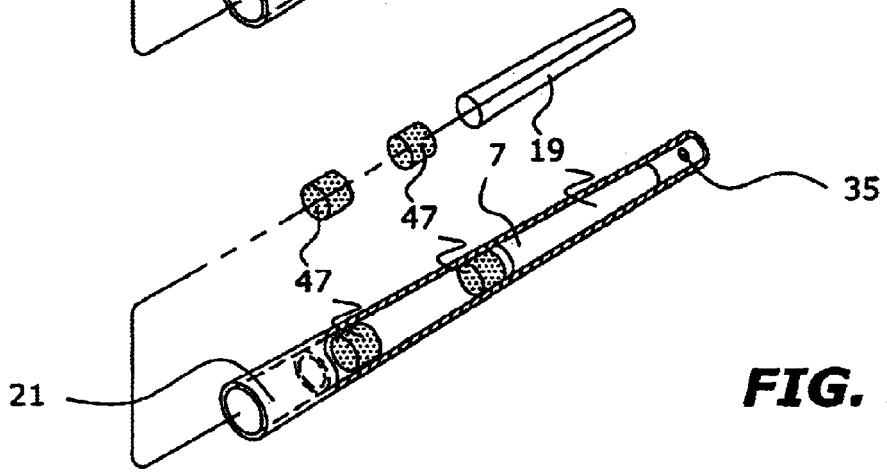

An element of the present invention is a tip section 7 wherein certain operational characteristics may be altered, such as the weight and balance and/or the flex and kick of the tip section 7. The balance and weight of the tip section 7 and the cue stick 44 may be altered by the introduction of weights 17, 47 into the hollow interior of the tip section 7. The weights 17, 47 may be placed in two general areas, the placement depends on the degree to which the weight and balance of the cue stick 44 are to be altered. To effect changes in balance, a weight 17 may be placed immediately behind the tip attachment point 35 such as from the narrow end 11 to 4 inches from the narrow end 11, as illustrated in FIG. 3*a*. Weights 17 placed behind the tip attachment point 35 are typically less than 100 grams. To effect large changes in the weight and balance of a cue stick, the weights 47 are placed in the tip section 7 from 12.5 to 25 inches from the narrow end 11, as illustrated in FIG. 3*b*. The weights 47 in the tip section 7 from 12.5 to 25 inches from the narrow end 11 are typically less than 200 grams. A single weight 17 or 47 may be inserted into the tip section 7, or combinations of two or more weights 17, 47 may be inserted into the tip section 7.

The weights 17, 47 may be produced from a variety of materials such as wood, plastic, metals and the like. As will be obvious to those skilled in the art, the choice of material used will depend on the desired weight needed. The weights 17, 47 are preferably of a generally disc, cone or cylinder shape, though weights 17, 47 of various shapes may be used. The weight 17, 47 may also be provided in different lengths to provide the desired mass. The weight 17, 47 should be of a shape and size such that it may enter into the desired area of the tip section 7. In a preferred embodiment, the weights 17, 47 are fixed at a desired location within the tip section 7, the exact position being determined by tailoring the outside diameter of the weight 17, 47 to the inside diameter of the body of the tip section 7 at the desired location. The weights 17, 47 may also be affixed in a specific area of the tip section 7 by various methods such as adhesives, welding and the like.

To alter the flex and kick of a cue stick 44, a stiffening member 19 may be inserted into the interior of the tip section 7. Stiffening members 19 are generally longer than a typical weight 17, and the shapes may include solid cylinders, tubes, cones, and the like. Stiffening members 19 may be manufactured from a variety of materials such as wood, plastic, high-tensile metal, steel, and the like. The choice of material from which the stiffening member 19 is produced will depend on the desired magnitude of the change required in flex and kick. One location for the stiffening member 19 is behind the weight 17 located adjacent to the narrow end 11. Small changes in flex and kick may be affected by the use of wood and perhaps plastic stiffening members. Larger changes in flex and kick require the use of plastics and metal stiffening members. The stiffening member 19 will be affixed within the tip section 7 behind the tip attachment point 35. If a weight 17 is behind the tip attachment point 35, then the stiffening member 19 is placed behind the weight 17 toward the wide end 34 of the tip section 7. The insertion of stiffening members 19 may be either in addition to, or instead of the addition of weights 17, 47. Typical stiffening members 19 are between 1 and 10 inches in length.

Figure 3C:
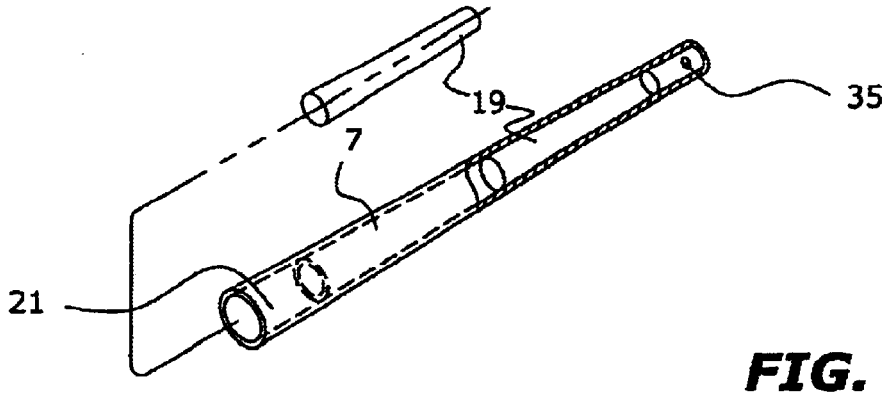
Figure 4:
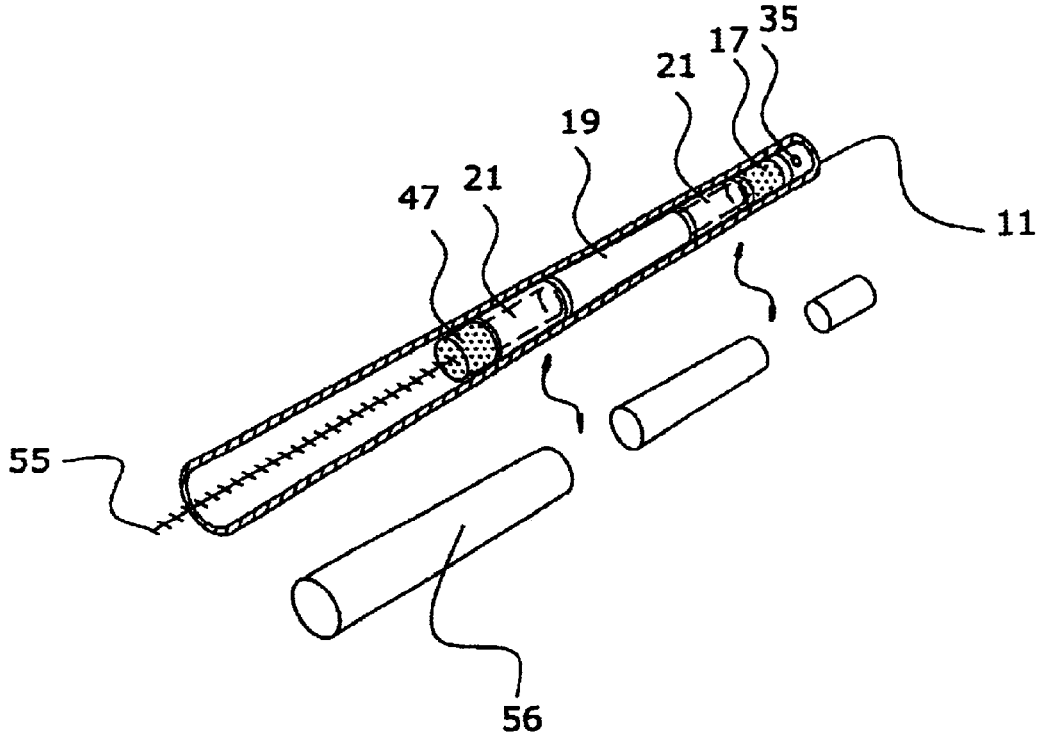
FIG. 4 is an alternate embodiment of the tip section of FIG. 2.

In an alternate embodiment, illustrated in FIG. 3*c*, the stiffening member 19 may be a hollow section of metallic tubing of the same material used to construct the tip section 7. Such an embodiment will effect more extreme changes in flex and kick of the cue stick, as well as affecting the weight and balance of the cue stick. The diameter of the stiffening member 19 should be less than the interior diameter of the tip section 7 to allow the stiffening member 19 to be inserted into the tip section 7.

The positioning of weights 17, 47 and stiffening member 19 within the tip section 7 will affect the overall weight, balance, flex and kick of the tip section 7. The ability to customize the tip section 7 of the present invention to the desired operational characteristics of the user depends on the ability to position the weights 17, 47 and stiffening member 19 within the tip section 7. Positioning the weights 17, 47 and stiffening member 19 is achieved by a locator. Although the exact nature of the locator may differ in the various embodiments, the function of the locator will be to position the weights 17, 47 and stiffening member 19 within the tip section 7.

In one embodiment, the locator is spacer material 21 inserted into the interior of the tube to position the weights 17, 47 and stiffening members 19 within the tip section 7. Spacer material 21 is typically material which is sufficiently dense to inhibit movement of the weights 17, 47 and stiffening members 19. An example of spacer material 21 is closed cell foam plastic, though other materials such a balsa wood may also be used. Pieces of the spacer material 21 may be cut and shaped to fit into the interior of the tip section 7. The spacer material 21 may be inserted into the tip section 7 and used to temporarily secure the position of the weights 17 and stiffening members 19 until the cue stick has the desired operational characteristics. Once the desired operational characteristics have been attained, the spacer material 21, weights 17, 47 and stiffening members 19 may be secured into position by the use of adhesives, or other securing means previously described.

In an alternate embodiment, the locator is spacer material 21 shaped to match the dimensions of the interior of the tip section 7, such as in the form of a spacer rod 56. Spacer material 21 is removed from the tip section 7 and sections of the spacer material 21 may be cut out of the rod 56 and replaced with either weights 17, 47 or stiffening member 19. The weight 17, 47, stiffening member 19 and spacer material 19 may then be inserted into the tip section 7. The positions of the weights 17, 47 and stiffening elements 19 may be altered by replacing different sections of spacer material with weights 17, 47 and stiffening elements 19 until the desired operational characteristics are achieved. The stiffening member 19 may also be secured by suspending the stiffening member 19 between two pieces of spacer material 21.

In another embodiment, the locator may be a small tube which fits into the interior space of the hollow tube 57. Weights 17, 47, stiffening member 19, and spacer material 21 may be inserted into the small tube, which is the fitted into the hollow tube 57 of the tip section 7. The position and composition of the weights 17, 47 and stiffening members 19 may be changed until the operational characteristics of the tip section 7 and the cue stick 44 are acceptable to the user. The weights 17, 47 and stiffening member 19 may then be secured within the small tube, which is then secured in the tip section 7. Alternatively, the weights 17, 47 and stiffening member 19 may be secured directly within the tip section in positions corresponding to their placement within the small tube.

In another embodiment wherein the interior space of the tube is tapered, and the locator may be the use of the taper to position the weights 17, 47 and stiffening members 19. The outside diameters of the weights 17, 47 and stiffening members 19 may be tailored to match the inside diameter of the tip section 7 at the location where the weight 17, 47 or stiffening member 19 is to be placed. The user may be provided with a variety of weights 17, 47 and stiffening members 19 of varying diameters, which may be inserted into the tip section 7 in various combinations until the operational characteristics of the cue stick 44 are acceptable to the user. The weights 17, 47 and stiffening members 19 may then be secured in position by the use of adhesive, friction or other securing means. Alternatively, the outside diameters of the weights 17, 47 and stiffening members 19 may be altered by a variety of methods. In one embodiment, the diameters are altered by the addition or removal of tape from around the weights 17, 47 and stiffening members 19. The diameter of the weights 17, 47 or stiffening members 19 may be decreased by the use of a lathe or by whittling.

The locator may include a ruler 55 or other measuring devise that may be inserted into the interior of the tip section 7. A weight 17, 47 or stiffening member 19 is inserted into the tip section 7, and the ruler may be used to push the weight 17, 47 or stiffening member 19 a desired distance into the tip section 7. The ruler 55 used as the locator, the weights 17, 47 and stiffening members 19 may be of a shape to allow insertion into the interior of the tip section 7. Once in the desired location, the weight 17, 47 and stiffening member 19 may be secured into position by the use of adhesives of other methods described above.

Following the introduction of the weights 17, 47 and stiffening members 19 into the tip section 7, the cut tip attachment site 35 and the butt section attachment site 9 may be attached to the narrow end 11 and wide end 34 of the tip section 7, respectively. An embodiment of the present invention, illustrated in FIG. 2, is of a cue stick 44 of a detachable two piece design. The present invention may also be applied to one-piece cue sticks wherein the two pieces illustrated in FIG. 2 are permanently attached to one another. In such a design, the tip section 7 may be attached to a wooden butt section 30 or to a butt section 30 compose of the same material as the tip section 7. In an alternate embodiment, the entire cue stick may be produced from one piece of tapered tube. In such an embodiment, the joint member 48 is not present. It is recognized that the weight 17, 47, spacer 21 and stiffening members 19 can be inserted and secured s described above in a hollow butt section 30, if desired.

In certain circumstances, a wooden cue stick 44 may become damaged or warped near the tip end 11, or the tip end 11 may become deformed, cracked, or broken off. Ordinarily, such a cue stick 44 would be discarded. In one embodiment, the tip section 7 may be attached to the butt section 30 of a damaged cue stick. The damaged cue stick's tip section 7 is removed. A hollow tube 57 is prepared wherein the length, diameter and taper is similar to the removed tip section 7. The narrow end 36 of the butt section 30 may be fitted with an attachment site for a releasable or non-releasable joint member 48. Alternatively, the diameter of the narrow end 36 of the butt section 30 may be reduced to allow it to fit into the internal diameter of the wide end 34 of the tip section 7. The diameter of the narrow end 36 of the butt section 30 may be reduced by whittling, being turning, sanding or shaving. The operational characteristics of the tip section 7 may be tailored by the insertion of weights 17, 47 and stiffening members 19 as previously described. The tip section 7 may then be attached to the prepared butt section 30. The attachment may be permanent or a releasable joint 48, as described above.

The tip section 7 may be manufactured either to standard specifications into an assembled unit, or can be partly assembled to allow for customization to suit specific requirements of the user. An embodiment of the present invention is to provide the tip section 7 in a kit form. Such a kit may include a hollow tube 57 having, at one end, an attachment point 35 for a cue tip 40 and, at the opposite end 34, an attachment point 8 for a butt section 30. The kit may also include weights 17, 47 and stiffening members 19 and a locator such as spacer material 21. The kit may then be assembled and the operational characteristics of the tip section modified to specifications of the user.

It should be noted that alterations to the weight, balance, flex and kick and overall operational characteristics of a cue stick can be accomplished by the insertion of weights 17, 47 stiffening members 19 and spacer material 21 as noted above in certain sizes, shapes, compositions and locations within the tip section 7. As such, the exact dimensions of the materials added will be determined by or in consultation with the user, by trial and error, by calculation, or by some combination of those activities. The criteria for successful adjustment of the weight, balance, kick and flex of the resulting cue stick 44 being the satisfaction of the individual user with the cue stick 44 in play.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. A tip section for customizing a cue stick, the tip section comprising:

(a) a single-piece tapered metallic tube having a hollow body terminating in a first end and a second end, said hollow body being defined by a wall capable of self-support and of carrying required physical loads ansing during use, said wall having an exterior providing a substantially smooth surface, said second end permitting connection to a butt section of the cue stick;

(b) a cue tip, having a threaded body, for attachment at said first end; and (c) a plurality of insertable augmenting elements for interacting with locating means, within said hollow body, the locating means including an interior taper in said hollow body for interaction with correspondingly tapered insertable augmenting elements sized for their selective placement at desired locations along the interior taper of said hollow body to permit selective placement and fixation of said plurality of augmenting elements within said hollow body to selectively adjust at least two of weight, balance, flex and tactile feedback of the cue stick to customize the cue stick in accordance with a user's preference.

2. The tip section of claim 1, wherein said plurality of insertable augmenting elements include a selection of weights and stiffening members.

3. The tip section of claim 1, wherein the tube is composed of a metal selected from the group consisting of: lightweight steel, polished aluminum, magnesium alloy and stainless steel.

4. The tip section of claim 2, wherein said stiffening members are between 1 and 10 inches in length.

5. The lip section of claim 2, wherein said stiffening members are composed of materials selected from the groups consisting of wood, plastic, high-tensile metal, lightweight steel, aluminum, magnesium alloy and stainless steel.

6. The tip section of claim 1 wherein said exterior of the tube is provided by one of: chrome-plating, polished aluminum, titanium, high-gloss finishing, and polishing.

7. The tip section of claim 1, wherein said locating means include insertable locators for selectively positioning and spacing said augmenting members within the hollow body.

8. A kit for customizing a tip section of a cue stick, the kit comprising:

(a) a single-piece tapered hollow metallic tube having a first end and a second end, said first end having a first attachment site for attaching a cue tip having a threaded body, said second end having an attachment site for connection to a butt section of the cue stick, the hollow tube having an exterior providing a substantially smooth surface, the hollow tube having a wall capable of self-support and of carrying required physical loads arising during use; and (b) a plurality of augmenting elements, including weights and stiffening members, contoured for insertion and fixation within the hollow tube at selectable positions determined by cooperation with locating means within the hollow tube to selectively adjust at least two of weight, balance, flex and tactile feedback of the cue stick for customization of the cue stick in accordance with a user's preference, said augmenting element being selectively sized to correspond to desired locations along an interior taper of the hollow tube.

9. The kit of claim 8, wherein said locating means include a selection of insertable locators for selectively positioning and spacing said augmenting members within the hollow tube.

10. The kit of claim 8, further comprising a selection of cue tips.

* * * * *